US009804512B2

(12) United States Patent
Tokimitsu et al.

(10) Patent No.: US 9,804,512 B2
(45) Date of Patent: Oct. 31, 2017

(54) ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Ryoichi Tokimitsu, Kashiwa (JP); Yuka Ishiduka, Suntou-gun (JP); Wataru Kitamura, Abiko (JP); Mai Murakami, Kashiwa (JP); Kan Tanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/775,333

(22) PCT Filed: Mar. 6, 2014

(86) PCT No.: PCT/JP2014/056592
§ 371 (c)(1),
(2) Date: Sep. 11, 2015

(87) PCT Pub. No.: WO2014/142215
PCT Pub. Date: Sep. 18, 2014

(65) Prior Publication Data

US 2016/0026099 A1 Jan. 28, 2016

(30) Foreign Application Priority Data

Mar. 13, 2013 (JP) ..... 2013-050343

(51) Int. Cl.
*G03G 5/00* (2006.01)
*G03G 5/14* (2006.01)
*G03G 5/05* (2006.01)

(52) U.S. Cl.
CPC ..... *G03G 5/144* (2013.01); *G03G 5/0517* (2013.01)

(58) Field of Classification Search
CPC ..... G03G 5/144; G03G 5/0521
(Continued)

(56) References Cited

U.S. PATENT DOCUMENTS

2007/0202422 A1 8/2007 Levy
2007/0286644 A1* 12/2007 Takegawa ..... G03G 5/04 399/159

FOREIGN PATENT DOCUMENTS

JP 7-261419 A 10/1995
JP 11-258844 A 9/1999
(Continued)

OTHER PUBLICATIONS

Krasnosel'skaya, et al., "Synthesis of Leuc0-1,4,5,8-Tetrahydroxyanthraquinone", Rubezhnoe Branch, Scientific Research Institute of Organic Intermediates and Dyes (NIOPI K) . Scientific-Industrial Association of NIOPIK. Translated from Zhurnal Prikladnoi Khirnii, vol. 60, No. 10, pp. 2326-2330, Oct. 1987.

(Continued)

*Primary Examiner* — Mark A Chapman
(74) *Attorney, Agent, or Firm* — Canon U.S.A. Inc., IP Division

(57) ABSTRACT

An electrophotographic photosensitive member includes a support, an undercoat layer which contains a metal oxide particle and is formed on the support, a charge generating layer formed on the undercoat layer, and a charge transport-
(Continued)

ing layer formed on the charge generating layer. Either or both of the undercoat layer and the charge generating layer contain a compound represented by formula (1).

11 Claims, 2 Drawing Sheets

(58) Field of Classification Search
USPC ..... 430/60, 59.1
See application file for complete search history.

(56) References Cited

FOREIGN PATENT DOCUMENTS

| | | | |
|---|---|---|---|
| JP | 2006-030697 | A | 2/2006 |
| JP | 2006-030699 | A | 2/2006 |
| JP | 2006-221094 | A | 8/2006 |
| JP | 2008-250083 | A | 10/2008 |
| JP | 4581781 | B2 | 11/2010 |
| JP | 2013-114178 | A | 6/2013 |
| JP | 2013-137518 | A | 7/2013 |

OTHER PUBLICATIONS

Almlof et al., "Electronic Structure and Near-Infrared Spectra of Diquinone Anion Radicals", Journal of the American Chemical Society, vol. 112, No. 3, pp. 1206-1214, 1990.
Bingham et al., "C-Alkylation of Methyl leuco-6-Deoxykermesate by Aldol Reactions and its Application to Synthesis of Carminic Acid", Journal of Chemical Research, pp. 546-547, 1998.
Bingham et al., "C-Alkylation of Methyl leuco-6-Deoxykermesate by Aldol Reactions and its Application to Synthesis of Carminic Acid", Journal of Chemical Research, pp. 2465-2496, 1998.
Takimiya et al., Syntheses and Properties of Dimethyl and Tetramethyl Anthra[1,9-cd:4,10-c'd']-bis[1,2]dichalcogenoles and Their Charge-Transfer Complexes, Bulletin of the Chemical Society of Japan, vol. 64, No. 7, pp. 2091-2102, 1991.

* cited by examiner

ELECTROPHOTOGRAPHIC PHOTOSENSITIVE MEMBER, METHOD FOR PRODUCING ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a method for producing an electrophotographic photosensitive member, a process cartridge, and an electrophotographic apparatus.

BACKGROUND ART

Electrophotographic photosensitive members including a support, an undercoat layer formed on the support, and a photosensitive layer formed on the undercoat layer and containing an organic photoconductive substance (charge generating substance) have been often used as electrophotographic photosensitive members for electrophotographic apparatuses. The undercoat layer has a charge-blocking function and thus suppresses the charge injection from the support to the photosensitive layer. Consequently, formation of image defects such as black spots is suppressed.

In recent years, charge generating substances having higher sensitivity have been used. However, such an increase in the sensitivity of charge generating substances results in an increase in the amount of charge generated. As a result, charge easily remains in the photosensitive layer, which poses a problem in that ghosts are easily formed. Specifically, a so-called "positive ghost" phenomenon in which an image density increases only in a portion irradiated with light in the previous rotation or a so-called "negative ghost" phenomenon in which an image density decreases only in a portion irradiated with light in the previous rotation easily occurs in an output image.

PTL 1 discloses a technique in which an undercoat layer includes a metal oxide particle and a compound having an anthraquinone structure as a technique of suppressing such a ghosting phenomenon. PTL 2 discloses a technique in which a charge generating layer in a multilayer photosensitive layer includes a phthalocyanine pigment and a compound having an anthraquinone structure.

In recent years, for example, with an increasing number of electrophotographic apparatuses having a color function, higher speed and higher image quality have been required for such electrophotographic apparatuses, and higher performance has been also required for electrophotographic photosensitive members. For example, the degradation of image quality caused by a ghosting phenomenon needs to be suppressed in various environments.

CITATION LIST

Patent Literature

PTL 1 Japanese Patent Laid-Open No. 2006-221094
PTL 2 Japanese Patent No. 4581781

SUMMARY OF INVENTION

Technical Problem

However, as a result of studies conducted by the inventors of the present invention, the techniques disclosed in PTL 1 and PTL 2 still have room for improvement because the degradation of image quality caused by a ghosting phenomenon is not sufficiently suppressed in some cases.

The present invention provides an electrophotographic photosensitive member in which the degradation of image quality caused by a ghosting phenomenon is suppressed in various environments and a method for producing the electrophotographic photosensitive member. The present invention also provides a process cartridge and an electrophotographic apparatus each including the electrophotographic photosensitive member.

Solution to Problem

According to an aspect of the present invention, an electrophotographic photosensitive member includes a support, an undercoat layer which contains a metal oxide particle and is formed on the support, a charge generating layer formed on the undercoat layer, and a charge transporting layer formed on the charge generating layer, wherein either or both of the undercoat layer and the charge generating layer include a compound represented by the following formula (1).

[Chem. 1]

(1)

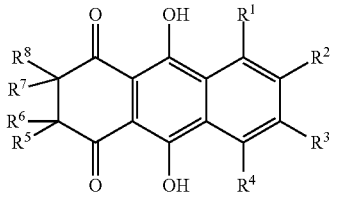

In the formula (1), $R^1$ to $R^8$ each independently represents a hydrogen atom, an alkyl group, a hydroxy group, an amino group, or a carboxyl group.

According to another aspect of the present invention, a method for producing an electrophotographic photosensitive member including an undercoat layer which contains a metal oxide particle and is formed on a support, a charge generating layer formed on the undercoat layer, and a charge transporting layer formed on the charge generating layer includes forming a coat of an undercoat layer coating solution containing the metal oxide particle and a compound represented by the formula (1) on a support and drying the coat by heating to form an undercoat layer.

According to another aspect of the present invention, a method for producing an electrophotographic photosensitive member including an undercoat layer which contains a metal oxide particle and is formed on a support, a charge generating layer formed on the undercoat layer, and a charge transporting layer formed on the charge generating layer includes forming a coat of a charge generating layer coating solution containing a charge generating substance and a compound represented by the formula (1) on an undercoat layer and drying the coat by heating to form a charge generating layer.

According to another aspect of the present invention, a process cartridge detachably attachable to a main body of an electrophotographic apparatus integrally supports the electrophotographic photosensitive member described above and at least one device selected from the group consisting of a charging device, a developing device, a transferring device, and a cleaning device.

According to another aspect of the present invention, an electrophotographic apparatus includes the electrophotographic photosensitive member described above, a charging device, an exposure device, a developing device, and a transferring device.

Advantageous Effects of Invention

The present invention can provide an electrophotographic photosensitive member in which the degradation of image quality caused by a ghosting phenomenon is suppressed in various environments and a method for producing the electrophotographic photosensitive member. The present invention can also provide a process cartridge and an electrophotographic apparatus each including the electrophotographic photosensitive member.

DESCRIPTION OF EMBODIMENTS

Figure 1:
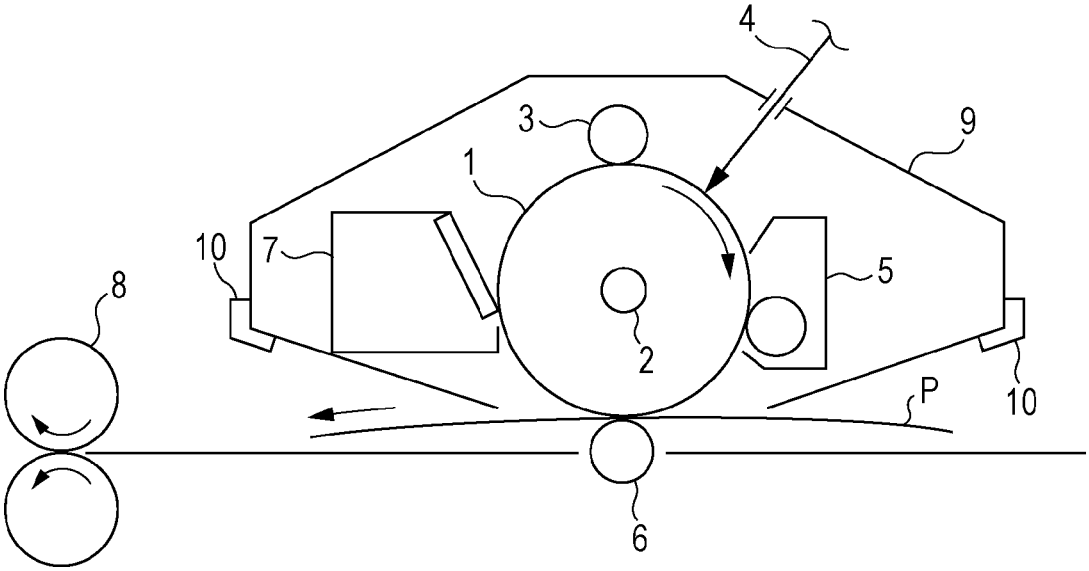
FIG. 1 schematically shows an example of an electrophotographic apparatus that includes a process cartridge including an electrophotographic photosensitive member.

In an embodiment of the present invention, either or both of an undercoat layer and a charge generating layer of an electrophotographic photosensitive member include a compound represented by formula (1) below.

[Chem. 1]

(1)

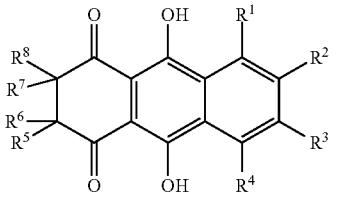

In the formula (1), $R^1$ to $R^8$ each independently represents a hydrogen atom, an alkyl group, a hydroxy group, an amino group, or a carboxyl group. Examples of the alkyl group include a methyl group, an ethyl group, a propyl group, and an isopropyl group.

The inventors of the present invention assume the reason why the degradation of image quality caused by a ghosting phenomenon is suppressed by adding the compound represented by the formula (1) above to at least one of the undercoat layer and the charge generating layer to be as follows.

The compound represented by the formula (1) is a compound having two hydroxy groups, two ketone groups, and a naphthalene ring. The compound represented by the formula (1) is believed to easily attract charges because the compound has ketone groups serving as electron attracting groups. The compound represented by the formula (1) has a naphthalene ring and thus has a large conjugated system, and is therefore believed to be a compound having high electron transportability. It is also believed that, since the compound represented by the formula (1) has hydroxy groups having acidic properties, the compound represented by the formula (1) that is present in a portion of the undercoat layer and/or the charge generating layer near an interface between the undercoat layer and the charge generating layer interacts with a metal oxide particle in the undercoat layer, resulting in the formation of an intramolecular charge transfer complex (composite). The intramolecular charge transfer complex constituted by the compound represented by the formula (1) and the metal oxide particle is formed near the interface between the undercoat layer and the charge generating layer, whereby receiving of charges (electrons) from a charge generating substance is assumed to be facilitated. Thus, electrons are smoothly received from the charge generating layer, which suppresses a ghosting phenomenon.

Specific examples of the compound represented by the formula (1) are described below, but the present invention is not limited thereto.

[Chem. 2]

(1-1)

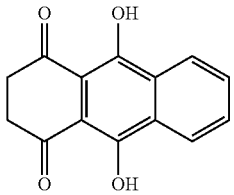

(1-2)

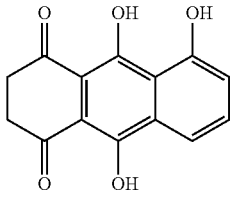

(1-3)

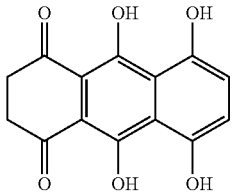

(1-4)

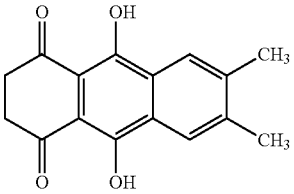

(1-5)

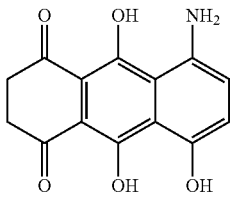

-continued (1-6)

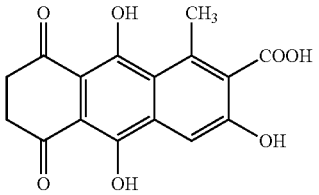

(1-7)

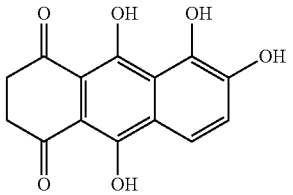

(1-8)

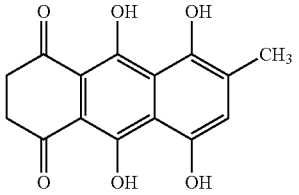

[Chem. 3]

(1-9)

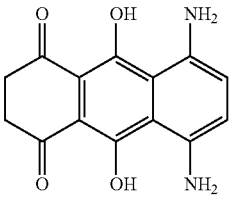

(1-10)

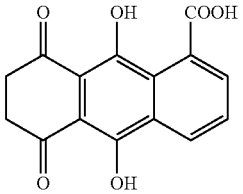

(1-11)

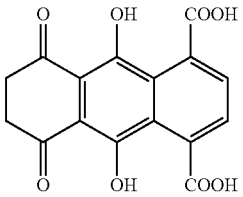

(1-12)

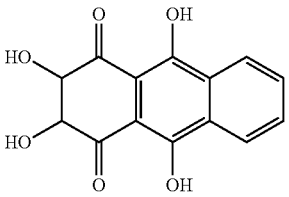

-continued (1-13)

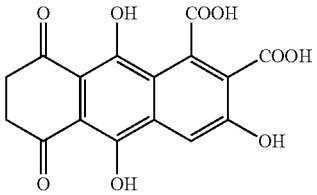

(1-14)

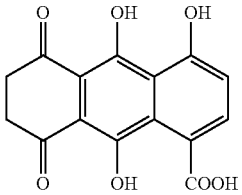

(1-15)

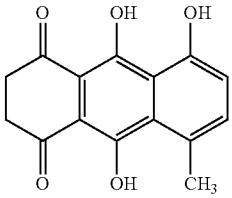

Among these compounds, compounds in which the substituents $R^1$ to $R^8$ in the compound represented by the formula (1) each independently represents a hydrogen atom or a hydroxy group can be used in terms of coordination with a metal oxide particle.

Furthermore, among the compounds exemplified above, the compound represented by the formula (1-1), (1-2), or (1-3) can be used from the viewpoint of suppressing a ghosting phenomenon in the repeated use in a low-temperature and low-humidity environment and a high-temperature and high-humidity environment.

The content of the compound represented by the formula (1) in the undercoat layer is preferably 0.01% by mass or more and 50% by mass or less and more preferably 0.05% by mass or more and 4% by mass or less relative to the metal oxide particle. When the content is 0.05% by mass or more and 4% by mass or less, the compound represented by the formula (1) and the metal oxide particle sufficiently interact with each other, which suppresses the interaction between the compounds represented by the formula (1). Consequently, a higher effect of suppressing a ghosting phenomenon is produced.

The content of the compound represented by the formula (1) in the charge generating layer is preferably 0.02% by mass or more and 20% by mass or less and more preferably 0.1% by mass or more and 2% by mass or less relative to the charge generating substance. When the content is 0.1% by mass or more and 2% by mass or less, the compound represented by the formula (1), the charge generating substance, and the metal oxide particle that is present in the undercoat layer near the interface between the undercoat layer and the charge generating layer sufficiently interact with one another, which suppresses the interaction between the compounds represented by the formula (1). Consequently, a higher effect of suppressing a ghosting phenomenon is produced.

The metal oxide particle contained in the undercoat layer is preferably a particle containing titanium oxide, zinc oxide, tin oxide, zirconium oxide, or aluminum oxide and more preferably a particle containing titanium oxide, tin oxide, zinc oxide, or aluminum oxide. The metal oxide particle may also be a metal oxide particle whose surface is treated with a surface-treating agent such as a silane coupling agent.

Examples of the silane coupling agent include N-2-(aminoethyl)-3-aminopropylmethyldimethoxysilane, 3-aminopropylmethyldiethoxysilane, (phenylaminomethyl) methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, vinyltrimethoxysilane, 3-aminopropyltriethoxysilane, N-(2-aminoethyl)-3-aminopropyltrimethoxysilane, methyltrimethoxysilane, 3-glycidoxypropyltrimethoxysilane, 3-methacryloxypropyltrimethoxysilane, 3-chloropropyltrimethoxysilane, and 3-mercaptopropyltrimethoxysilane.

The electrophotographic photosensitive member according to an embodiment of the present invention is an electrophotographic photosensitive member including a support, an undercoat layer formed on the support, a charge generating layer formed on the undercoat layer, and a charge transporting layer that is formed on the charge generating layer and contains a charge transporting substance. A protective layer (second charge transporting layer) may be further formed on the charge transporting layer.

Figure 2:
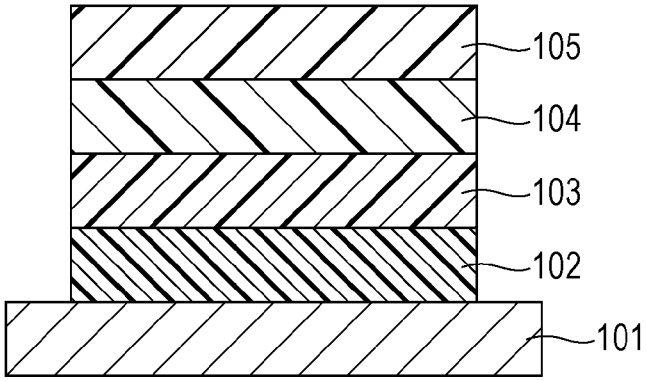
FIG. 2 shows an example of a layer structure of the electrophotographic photosensitive member.

FIG. 2 shows an example of a layer structure of the electrophotographic photosensitive member. In FIG. 2, the electrophotographic photosensitive member includes a support 101, an undercoat layer 102, a charge generating layer 103, a charge transporting layer 104, and a protective layer 105.

Support

The support can be a support having electrical conductivity (electroconductive support), for example, made of a metal or an alloy such as aluminum, stainless steel, copper, nickel, or zinc. An aluminum or aluminum alloy support may be an ED tube, an EI tube, or a support manufactured by cutting, electrochemical mechanical polishing (electrolysis performed with electrodes and an electrolytic solution that provide an electrolysis action and polishing performed with grindstone that provides a polishing action), or wet or dry honing of the ED or EI tube. A metal support or a resin support may be covered with a thin film made of an electroconductive material such as aluminum, an aluminum alloy, or an indium oxide-tin oxide alloy. The support can have a cylindrical shape, a belt-like shape, or a sheet-like shape and, in particular, can have a cylindrical shape.

The surface of the support may be subjected to a cutting treatment, a surface roughening treatment, or an anodizing treatment to suppress interference fringes caused by scattering of laser beams.

An electroconductive layer may be formed between the support and the undercoat layer to suppress interference fringes caused by scattering of laser beams or to cover scratches formed on the support. The electroconductive layer can be formed by applying an electroconductive layer coating solution prepared by dispersing carbon black and electroconductive particles together with a binder resin and a solvent and drying (heat curing) the obtained coat by heating.

Examples of the binder resin used for the electroconductive layer include polyester resin, polycarbonate resin, polyvinyl butyral resin, acrylic resin, silicone resin, epoxy resin, melamine resin, urethane resin, phenolic resin, and alkyd resin.

Examples of the solvent for the electroconductive layer coating solution include ether solvents, alcohol solvents, ketone solvents, and aromatic hydrocarbon solvents. The thickness of the electroconductive layer is preferably 5 to 40 μm and particularly preferably 10 to 30 μm.

Undercoat Layer

The undercoat layer is disposed between the support or the electroconductive layer and the charge generating layer.

The undercoat layer contains the compound represented by the formula (1) and the metal oxide particle and, when necessary, a binder resin. Alternatively, the undercoat layer contains the metal oxide particle and, when necessary, a binder resin.

Examples of the binder resin include acrylic resin, allyl resin, alkyd resin, ethyl cellulose resin, ethylene-acrylic acid copolymers, epoxy resin, casein resin, silicone resin, gelatin resin, phenolic resin, butyral resin, polyacrylate resin, polyacetal resin, polyamide-imide resin, polyamide resin, polyallyl ether resin, polyimide resin, polyurethane resin, polyester resin, polyethylene resin, polycarbonate resin, polystyrene resin, polysulfone resin, polyvinyl alcohol resin, polybutadiene resin, and polypropylene resin. Among them, polyurethane resin can be particularly used.

The content of the binder resin in the undercoat layer can be 10% by mass or more and 50% by mass or less relative to the metal oxide particle. When the content is 10% by mass or more and 50% by mass or less, high uniformity of the undercoat layer is achieved.

The undercoat layer can be formed by forming a coat of an undercoat layer coating solution prepared by dispersing the metal oxide particle, the compound represented by the formula (1), and the binder resin together with a solvent and then drying the coat by heating. The undercoat layer coating solution may be prepared by a method in which a solution including a binder resin dissolved therein is added to a dispersion liquid obtained by dispersing the metal oxide particle and the compound represented by the formula (1) together with a solvent and furthermore the resulting mixture is subjected to a dispersion treatment. The dispersion may be performed with a homogenizer, an ultrasonic disperser, a ball mill, a sand mill, a roll mill, a vibration mill, an attritor, or a liquid collision high speed disperser.

Examples of the solvent used for the undercoat layer coating solution include organic solvents such as alcohol solvents, sulfoxide solvents, ketone solvents, ether solvents, ester solvents, halogenated aliphatic hydrocarbon solvents, and aromatic compounds.

The undercoat layer may further contain organic resin fine particles and a leveling agent.

The thickness of the undercoat layer is preferably 0.5 μm or more and 30 μm or less and more preferably 1 μm or more and 25 μm or less.

Charge Generating Layer

A charge generating layer is formed on the undercoat layer.

The charge generating layer contains the compound represented by the formula (1) and a charge generating substance and, when necessary, a binder resin.

Alternatively, the charge generating layer contains a charge generating substance and, when necessary, a binder resin.

Examples of the charge generating substance include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinoneimine dyes, and styryl dyes. These charge generating substances may be used alone or in combination of two or more. Among these charge generating substances, phthalocyanine pigments and azo pigments can be used and phthalocyanine pigments can be particularly used from the viewpoint of sensitivity.

Among the phthalocyanine pigments, in particular, oxytitanium phthalocyanines, chlorogallium phthalocyanines, and hydroxygallium phthalocyanines exhibit high charge-generating efficiency.

Examples of the binder resin used in the charge generating layer include acrylic resin, allyl resin, alkyd resin, epoxy resin, diallyl phthalate resin, styrene-butadiene copolymers, butyral resin, benzal resin, polyacrylate resin, polyacetal resin, polyamide-imide resin, polyamide resin, polyallyl ether resin, polyarylate resin, polyimide resin, polyurethane resin, polyester resin, polyethylene resin, polycarbonate resin, polystyrene resin, polysulfone resin, polyvinyl acetal resin, polybutadiene resin, polypropylene resin, methacrylic resin, urea resin, vinyl chloride-vinyl acetate copolymers, vinyl acetate resin, and vinyl chloride resin. Among them, butyral resin can be particularly used. These binder resins may be used alone or in combination of two or more as a mixture or a copolymer.

The charge generating layer can be formed by forming a coat of a charge generating layer coating solution prepared by dispersing the compound represented by the formula (1), the charge generating substance, and the binder resin together with a solvent and then drying the coat by heating. The charge generating layer may also be an evaporated film made of a charge generating substance.

The dispersion may be performed with a homogenizer, an ultrasonic disperser, a ball mill, a sand mill, a roll mill, a vibration mill, an attritor, or a liquid collision high speed disperser.

The content of the charge generating substance can be 0.3 parts by mass or more and 10 parts by mass or less relative to 1 part by mass of the binder resin.

Examples of the solvent used for the charge generating layer coating solution include alcohol solvents, sulfoxide solvents, ketone solvents, ether solvents, ester solvents, halogenated aliphatic hydrocarbon solvents, and aromatic compounds. The thickness of the charge generating layer is preferably 0.01 μm or more and 5 μm or less and more preferably 0.1 μm or more and 2 μm or less. The charge generating layer may optionally contain various additive agents such as a sensitizer, an antioxidant, an ultraviolet absorber, and a plasticizer.

Charge Transporting Layer

A charge transporting layer is formed on the charge generating layer. The charge transporting layer contains a charge transporting substance and a binder resin.

Examples of the charge transporting substance include triarylamine compounds, hydrazone compounds, styryl compounds, stilbene compounds, and butadiene compounds. These charge transporting substances may be used alone or in combination of two or more. Among them, triarylamine compounds can be used from the viewpoint of achieving high mobility of charge.

Examples of the binder resin used in the charge transporting layer include acrylic resin, acrylonitrile resin, allyl resin, alkyd resin, epoxy resin, silicone resin, phenolic resin, phenoxy resin, polyacrylamide resin, polyamide-imide resin, polyamide resin, polyallyl ether resin, polyarylate resin, polyimide resin, polyurethane resin, polyester resin, polyethylene resin, polycarbonate resin, polysulfone resin, polyphenylene oxide resin, polybutadiene resin, polypropylene resin, and methacrylic resin. Among them, polyarylate resin and polycarbonate resin can be used. These binder resins may be used alone or in combination of two or more as a mixture or a copolymer.

The charge transporting layer can be formed by forming a coat of a charge transporting layer coating solution prepared by dissolving the charge transporting substance and the binder resin in a solvent and then drying the coat.

In the charge transporting layer, the content of the charge transporting substance can be 0.3 parts by mass or more and 10 parts by mass or less relative to 1 part by mass of the binder resin. The drying temperature is preferably 60° C. or more and 150° C. or less and more preferably 80° C. or more and 120° C. or less from the viewpoint of suppressing the formation of cracks in the charge transporting layer. The drying time can be 10 minutes or more and 60 minutes or less.

Examples of the solvent used for the charge transporting layer coating solution include alcohol solvents such as propanol and butanol; aromatic hydrocarbon solvents such as anisole, toluene, xylene, and chlorobenzene; and methylcyclohexane and ethylcyclohexane.

In the case where the charge transporting layer of the electrophotographic photosensitive member has a single layer structure, the thickness of the charge transporting layer is preferably 5 μm or more and 40 μm or less and more preferably 8 μm or more and 30 μm or less. In the case where the charge transporting layer has a multilayer structure, the thickness of a charge transporting layer on the support side can be 5 μm or more and 30 μm or less, and the thickness of a charge transporting layer on the surface side can be 1 μm or more and 10 μm or less.

The charge transporting layer may optionally contain an antioxidant, an ultraviolet absorber, a plasticizer, and the like.

A protective layer may also be formed on the charge transporting layer in order to protect the charge transporting layer and improve the abrasion resistance and ease of cleaning.

The protective layer can be formed by forming a coat of a protective layer coating solution prepared by dissolving a binder resin in an organic solvent and drying the coat. Examples of the resin used for the protective layer include polyvinyl butyral resin, polyester resin, polycarbonate resin, polyamide resin, polyimide resin, polyarylate resin, polyurethane resin, styrene-butadiene copolymers, styrene-acrylic acid copolymers, and styrene-acrylonitrile copolymers.

To provide charge transportability to the protective layer, the protective layer may be formed by curing a monomer material having charge transportability or a polymer charge transporting substance using a cross-linking reaction. In particular, the protective layer can be a layer cured by polymerizing or cross-linking a charge transporting compound having a chain-polymerizable functional group. Examples of the chain-polymerizable functional group include an acrylic group, a methacrylic group, an alkoxysilyl group, and an epoxy group. Examples of the curing reaction include radical polymerization, ionic polymerization, thermal polymerization, photopolymerization, radiation polymerization (electron beam polymerization), plasma chemical vapor deposition (CVD), and photo-CVD.

The thickness of the protective layer is preferably 0.5 μm or more and 10 μm or less and more preferably 1 μm or more and 7 μm or less. The protective layer may optionally contain electroconductive particles or the like.

The outermost layer (charge transporting layer or protective layer) of the electrophotographic photosensitive member may contain a lubricant such as silicone oil, wax, a fluorine-containing resin particle, e.g., a polytetrafluoroethylene particle, a silica particle, an alumina particle, or boron nitride.

The coating solution for each of the layers can be applied by dipping (dip coating), spray coating, spinner coating, roller coating, Meyer bar coating, blade coating, or the like.

Electrophotographic Apparatus

FIG. 1 schematically shows an electrophotographic apparatus that includes a process cartridge including an electrophotographic photosensitive member.

In FIG. 1, a cylindrical electrophotographic photosensitive member 1 is rotated about a shaft 2 at a predetermined peripheral speed (process speed) in a direction indicated by an arrow. During the rotation, the surface of the rotated electrophotographic photosensitive member 1 is uniformly charged at a predetermined negative potential by a charging device 3 (a first charging device such as a charging roller). The electrophotographic photosensitive member 1 is then irradiated with intensity-modulated exposure light (image exposure light) 4 emitted from an exposure device (not shown) such as a slit exposure device or a laser beam scanning exposure device, in response to the time-series electric digital image signals of intended image information. Thus, electrostatic latent images corresponding to intended image information are successively formed on the surface of the electrophotographic photosensitive member 1.

The electrostatic latent images formed on the surface of the electrophotographic photosensitive member 1 are subjected to reversal development with a toner contained in a developer in a developing device 5 and are made visible as toner images. The toner images formed on the surface of the electrophotographic photosensitive member 1 are then successively transferred onto a transfer member (e.g., paper) P by a transferring bias from a transferring device 6 (e.g., transfer roller). The transfer member P is taken from a transfer member feeding unit (not shown) in synchronism with the rotation of the electrophotographic photosensitive member 1 and is fed to a portion (contact portion) between the electrophotographic photosensitive member 1 and the transferring device 6. A bias voltage having polarity opposite to the polarity of the electric charge of the toner is applied to the transferring device 6 from a bias power supply (not shown).

The transfer member P onto which toner images have been transferred is separated from the surface of the electrophotographic photosensitive member 1 and is conveyed to a fixing device 8. After the toner images are fixed, the transfer member P is printed out from the electrophotographic apparatus as an image-formed article (print or copy). In the case where the transfer member P is an intermediate transfer body, toner images are fixed after a plurality of transferring processes and the transfer member P is printed out.

The surface of the electrophotographic photosensitive member 1 after the toner images have been transferred is cleaned by removing an untransferred developer (residual toner) with a cleaning device 7 (e.g., cleaning blade). When a cleanerless system is employed, such a residual toner can be directly collected with a developing device or the like. The electricity on the surface of the electrophotographic photosensitive member 1 is removed with pre-exposure light (not shown) from a pre-exposure device (not shown), and then the electrophotographic photosensitive member 1 is repeatedly used for image formation. In the case where the charging device 3 is a contact charging device such as a charging roller as shown in FIG. 1, pre-exposure is not necessarily required.

According to an embodiment of the present invention, a plurality of components among the electrophotographic photosensitive member 1, the charging device 3, the developing device 5, the transferring device 6, the cleaning device 7, and the like may be incorporated in a container and integrally joined to provide a process cartridge. The process cartridge may be detachably attachable to the main body of an electrophotographic apparatus such as a copying machine or a laser-beam printer. In FIG. 1, the electrophotographic photosensitive member 1 and the charging device 3, the developing device 5, and the cleaning device 7 are integrally supported to provide a process cartridge 9, which is detachably attachable to the main body of an electrophotographic apparatus using a guide unit 10 such as a rail of the main body.

In the case where the electrophotographic apparatus is a copying machine or a laser beam printer, the exposure light 4 is reflected light or transmitted light from a document. Alternatively, the exposure light 4 is light applied by scanning with a laser beam according to signals into which a document read by a sensor is converted, or driving of an LED array or a liquid-crystal shutter array.

EXAMPLES

The present invention will now be further described in detail based on specific Examples, but is not limited thereto. In Examples, "part" means "part by mass".

Example 1

An aluminum cylinder having a diameter of 30 mm and a length of 357.5 mm was used as a support (electroconductive support).

Next, 100 parts of a zinc oxide particle (specific surface: 19 $m^2/g$, powder resistivity: $4.7\times10^6$ Ω·cm) was mixed with 500 parts of toluene under stirring, and 0.8 parts of a silane coupling agent (compound name: N-2-(aminoethyl)-3-aminopropylmethyldimethoxysilane, trade name: KBM 602 manufactured by Shin-Etsu Chemical Co., Ltd.) was added thereto and stirring was performed for six hours. Subsequently, toluene was distilled off in a reduced pressure and drying by heating was performed at 130° C. for six hours to obtain a surface-treated zinc oxide particle.

Next, 15 parts of butyral resin (trade name: BM-1 manufactured by Sekisui Chemical Co., Ltd.) and 15 parts of a blocked isocyanate (trade name: Sumidur 3175 manufactured by Sumika Bayer Urethane Co., Ltd.) were dissolved in a mixed solution of 73.5 parts of methyl ethyl ketone and 73.5 parts of 1-butanol. To this solution, 80.8 parts of the surface-treated zinc oxide particle and 0.81 parts of a compound (manufactured by Sigma-Aldrich Co. LLC.) represented by the above formula (1-1) were added. The mixture was dispersed at 23±3° C. for three hours with a sand mill that uses glass beads having a diameter of 0.8 mm. After the dispersion, 0.01 parts of silicone oil (trade name: SH28PA manufactured by Dow Corning Toray Silicone Co., Ltd.) and 5.6 parts of cross-linked polymethyl methacrylate (PMMA) particles (trade name: TECK POLYMER SSX-102 manufactured by SEKISUI PLASTICS CO., Ltd., average primary particle size: 2.5 μm) were added thereto and stirred to prepare an undercoat layer coating solution.

The undercoat layer coating solution was applied onto the support by dip coating to form a coat, and the coat was dried by heating at 160° C. for 40 minutes to form an undercoat layer having a thickness of 18 μm.

Subsequently, 4 parts of a hydroxygallium phthalocyanine crystal (charge generating substance) having strong peaks at Bragg angles 2θ±0.2° of 7.4° and 28.1° in CuKα characteristic X-ray diffraction, 0.04 parts of the compound (manufactured by Sigma-Aldrich Co. LLC.) represented by the above formula (1-1), and 0.04 parts of a compound represented by formula (A) below were added to a solution obtained by dissolving 2 parts of polyvinyl butyral resin (trade name: S-LEC BX-1 manufactured by Sekisui Chemical Co., Ltd.) in 100 parts of cyclohexanone. The mixture was then dispersed at 23±3° C. for one hour with a sand mill that uses glass beads having a diameter of 1 mm. After the dispersion, 100 parts of ethyl acetate was added thereto and thus a charge generating layer coating solution was prepared. The charge generating layer coating solution was applied onto the undercoat layer by dip coating to form a coat, and the coat was dried by heating at 90° C. for 10 minutes to form a charge generating layer having a thickness of 0.21 μm.

[Chem. 4]

(A)

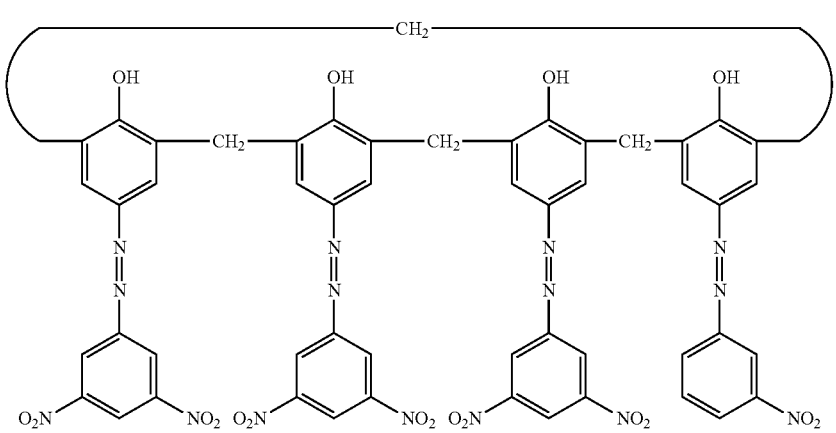

Next, 30 parts of a compound (charge transporting substance) represented by formula (B) below, 60 parts of a compound (charge transporting substance) represented by formula (C) below, 10 parts of a compound (charge transporting substance) represented by formula (D) below, 100 parts of polycarbonate resin (trade name: Iupilon 2400 manufactured by Mitsubishi Engineering Plastics Corporation, bisphenol Z polycarbonate), and 0.02 parts of polycarbonate resin having a structural unit represented by formula (E) below (viscosity-average molecular weight Mv: 20000) were dissolved in a mixed solvent of 600 parts of mixed xylene and 200 parts of dimethoxymethane to prepare a charge transporting layer coating solution. The charge transporting layer coating solution was applied onto the charge generating layer by dip coating to form a coat, and the coat was dried at 100° C. for 30 minutes to form a charge transporting layer having a thickness of 21 μm.

[Chem. 5]

(B)

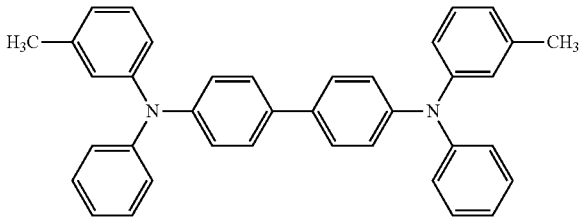

(C)

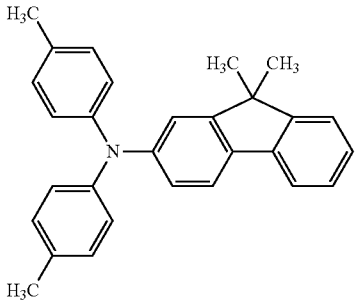

(D)

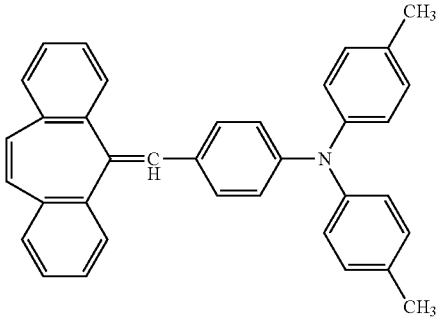

-continued

[Chem. 6]

(E)

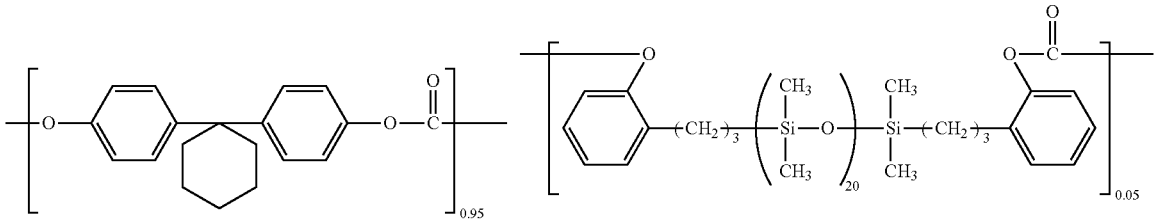

In the formula (E), 0.95 and 0.05 represent a copolymerization ratio of two repeating structural units.

Next, 36 parts of a compound (a charge transporting substance having an acrylic group, which is a chain-polymerizable functional group) represented by formula (F) below and 4 parts of polytetrafluoroethylene resin fine powder (LUBRON L-2 manufactured by DAIKIN INDUSTRIES, LTD.) were mixed with 60 parts of n-propyl alcohol, and then the mixture was dispersed with an ultra-high pressure disperser to prepare a protective layer coating solution.

The protective layer coating solution was applied onto the charge transporting layer by dip coating to form a coat, and the coat was dried at 50° C. for 5 minutes. After the drying, the coat was cured by being irradiated with an electron beam in a nitrogen atmosphere at an accelerating voltage of 70 kV at an absorbed dose of 8000 Gy for 1.6 seconds while rotating a cylinder. The coat was then heat-treated in a nitrogen atmosphere for three minutes under the condition that the temperature of the coat was 130° C. The processes from the electron beam irradiation to the three-minute heat treatment were performed at an oxygen concentration of 20 ppm. Subsequently, the coat was heat-treated in the air for 30 minutes under the condition that the temperature of the coat was 100° C., whereby a protective layer having a thickness of 5 μm was formed. [Chem. 7]

(F)

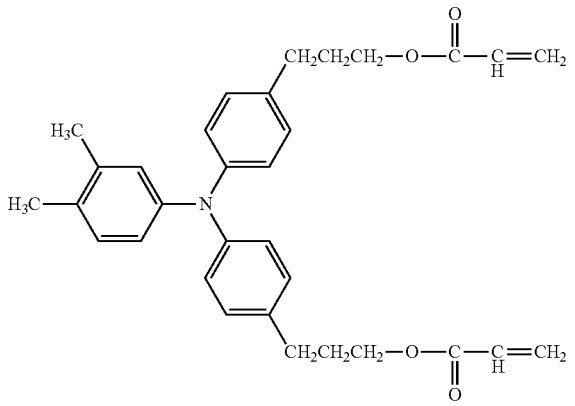

Accordingly, an electrophotographic photosensitive member including the undercoat layer, the charge generating layer, the charge transporting layer, and the protective layer disposed on the support in that order was produced.

Examples 2 to 45

An electrophotographic photosensitive member was produced in the same manner as in Example 1, except that the type and content of the compound represented by the formula (1) and used in the undercoat layer or the charge generating layer and the metal oxide particle used for the undercoat layer coating solution were changed as shown in Table 1.

In Table 1, a titanium oxide particle had a specific surface of 20.5 $m^2/g$ and a powder resistivity of $6.0\times10^5$ Ω·cm, a tin oxide particle had a specific surface of 40 $m^2/g$ and a powder resistivity of $1.0\times10^9$ Ω·cm, and an aluminum oxide particle was an aluminum oxide particle (trade name: AKP-50) manufactured by Sumitomo Chemical Company, Limited.

The compounds represented by the formulae (1-2), (1-3), (1-4), (1-5), (1-6), and (1-7) were synthesized with reference to Journal of the American Chemical Society, 112(3), pp. 1206-1214, Zhurnal Priklanonoi Khimii, 60(10), pp. 2326-2330, Bulletin of the Chemical Society of Japan, 64(7), pp. 2091-2102, and Journal of Chemical Research, Synopses (1998), (9), pp. 546-547 and 2465-2496.

TABLE 1

| | Under coat layer | | | Charge generating layer | |
|---|---|---|---|---|---|
| | | Compound represented by formula (1) | | Compound represented by formula (1) | |
| | Metal oxide particle | Type | Content relative to metal oxide particle (mass %) | Type | Content relative to charge generating substance (mass %) |
| Example 1 | Zinc oxide particle | Formula (1-1) | 1 | Formula (1-1) | 1 |
| Example 2 | Zinc oxide particle | Formula (1-1) | 0.02 | Formula (1-1) | 1 |
| Example 3 | Zinc oxide particle | Formula (1-1) | 0.05 | Formula (1-1) | 1 |
| Example 4 | Zinc oxide particle | Formula (1-1) | 2 | Formula (1-1) | 1 |

TABLE 1-continued

| | Under coat layer | | | Charge generating layer | |
|---|---|---|---|---|---|
| | | Compound represented by formula (1) | | Compound represented by formula (1) | |
| | Metal oxide particle | Type | Content relative to metal oxide particle (mass %) | Type | Content relative to charge generating substance (mass %) |
| Example 5 | Zinc oxide particle | Formula (1-1) | 4 | Formula (1-1) | 1 |
| Example 6 | Zinc oxide particle | Formula (1-1) | 6 | Formula (1-1) | 1 |
| Example 7 | Zinc oxide particle | Formula (1-1) | 1 | Formula (1-1) | 0.02 |
| Example 8 | Zinc oxide particle | Formula (1-1) | 1 | Formula (1-1) | 0.1 |
| Example 9 | Zinc oxide particle | Formula (1-1) | 1 | Formula (1-1) | 2 |
| Example 10 | Zinc oxide particle | Formula (1-1) | 1 | Formula (1-1) | 4 |
| Example 11 | Zinc oxide particle | Formula (1-1) | 6 | Formula (1-1) | 4 |
| Example 12 | Zinc oxide particle | Formula (1-1) | 0.03 | — | — |
| Example 13 | Zinc oxide particle | Formula (1-1) | 0.05 | — | — |
| Example 14 | Zinc oxide particle | Formula (1-1) | 1 | — | — |
| Example 15 | Zinc oxide particle | Formula (1-1) | 4 | — | — |
| Example 16 | Zinc oxide particle | Formula (1-1) | 6 | — | — |
| Example 17 | Zinc oxide particle | — | — | Formula (1-1) | 0.08 |
| Example 18 | Zinc oxide particle | — | — | Formula (1-1) | 0.1 |
| Example 19 | Zinc oxide particle | — | — | Formula (1-1) | 1 |
| Example 20 | Zinc oxide particle | — | — | Formula (1-1) | 2 |
| Example 21 | Zinc oxide particle | — | — | Formula (1-1) | 4 |
| Example 22 | Zinc oxide particle | Formula (1-2) | 1 | Formula (1-2) | 1 |
| Example 23 | Zinc oxide particle | Formula (1-2) | 1 | — | — |
| Example 24 | Zinc oxide particle | — | — | Formula (1-2) | 1 |
| Example 25 | Zinc oxide particle | Formula (1-3) | 1 | Formula (1-3) | 1 |
| Example 26 | Zinc oxide particle | Formula (1-3) | 1 | — | — |
| Example 27 | Zinc oxide particle | Formula (1-7) | 2 | — | — |
| Example 28 | Zinc oxide particle | Formula (1-5) | 1 | Formula (1-5) | 1 |
| Example 29 | Zinc oxide particle | Formula (1-5) | 2 | — | — |
| Example 30 | Zinc oxide particle | Formula (1-6) | 1 | Formula (1-6) | 1 |
| Example 31 | Zinc oxide particle | Formula (1-6) | 1 | — | — |
| Example 32 | Zinc oxide particle | — | — | Formula (1-6) | 1 |
| Example 33 | Zinc oxide particle | Formula (1-4) | 1 | — | — |
| Example 34 | Aluminum oxide particle | Formula (1-6) | 0.05 | Formula (1-6) | 2 |
| Example 35 | Aluminum oxide particle | Formula (1-3) | 0.05 | — | — |
| Example 36 | Titanium oxide particle | Formula (1-3) | 2 | — | — |
| Example 37 | Titanium oxide particle | Formula (1-3) | 1 | Formula (1-3) | 1 |
| Example 38 | Titanium oxide particle | Formula (1-1) | 0.05 | — | — |
| Example 39 | Titanium oxide particle | Formula (1-1) | 2 | — | — |
| Example 40 | Titanium oxide particle | Formula (1-1) | 4 | — | — |
| Example 41 | Titanium oxide particle | Formula (1-1) | 1 | Formula (1-1) | 1 |
| Example 42 | Tin oxide particle | Formula (1-1) | 2 | — | — |
| Example 43 | Tin oxide particle | Formula (1-3) | 2 | — | — |
| Example 44 | Tin oxide particle | Formula (1-1) | 1 | Formula (1-1) | 1 |
| Example 45 | Tin oxide particle | Formula (1-3) | 1 | Formula (1-3) | 1 |

Comparative Example 1

An electrophotographic photosensitive member was produced in the same manner as in Example 1, except that the compound represented by the formula (1-1) was not used for the undercoat layer and the charge generating layer.

Comparative Example 2

An electrophotographic photosensitive member was produced in the same manner as in Example 1, except that the zinc oxide particle was not used.

Comparative Example 3

An electrophotographic photosensitive member was produced in the same manner as in Example 14, except that the compound represented by the formula (1-1) was changed to a compound represented by formula (G) below.

[Chem. 8]

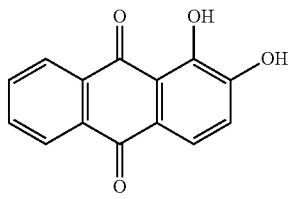

(G)

Comparative Example 4

An electrophotographic photosensitive member was produced in the same manner as in Example 19, except that the compound represented by the formula (1-1) was changed to the compound represented by the formula (G) above.

Evaluation

The electrophotographic photosensitive members in Examples 1 to 45 and Comparative Examples 1 to 4 were evaluated by the following method.

Ghost Image Evaluation

The ghost image evaluation in the repeated use of electrophotographic photosensitive members was performed on the electrophotographic photosensitive members in Examples 1 to 45 and Comparative Examples 1 to 4. In the ghost image evaluation, the degree of a ghosting phenomenon that occurs in an output image is evaluated.

A customized copying machine of imageRUNNER iR-ADV C5051 (trade name) manufactured by CANON KABUSHIKI KAISHA was used as an electrophotographic apparatus for evaluation.

The electrophotographic copying machine and each of the electrophotographic photosensitive members were left to stand in a low-temperature and low-humidity environment of 15° C. and 10% RH for three days. Subsequently, the laser light intensity and applied voltage were adjusted so that an initial light area potential was set to be −150 V and an initial dark area potential was set to be −750 V, and a ghost image evaluation was performed. Then, printing of 5000 sheets and printing of 10000 sheets were performed in the same environment. A ghost image evaluation immediately after the printing of 5000 sheets, a ghost image evaluation immediately after the printing of 10000 sheets, and a ghost image evaluation 15 hours after the printing of 10000 sheets were performed under the same laser light intensity conditions. In addition, printing was also performed in the same manner in a high-temperature and high-humidity environment of 30° C. and 80% RH and the ghost image evaluation was performed. Table 2 shows the evaluation results.

In the printing that used the electrophotographic photosensitive member, a line having a width of 0.5 mm was printed at intervals of 10 mm in the vertical direction in an intermittent mode in which four sheets can be printed per minute.

Figure 3A:
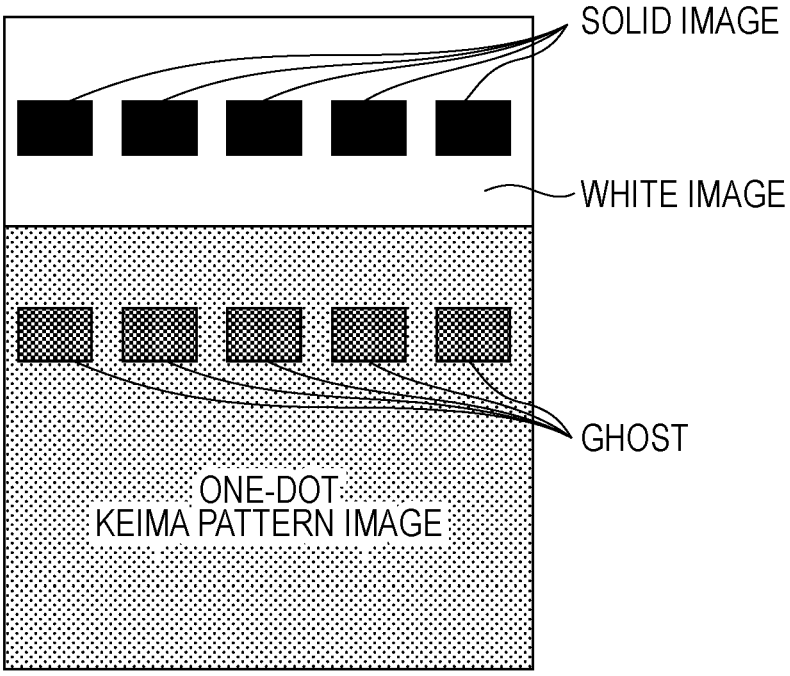
FIGS. 3A and 3B show images for ghost evaluation.
Figure 3B:
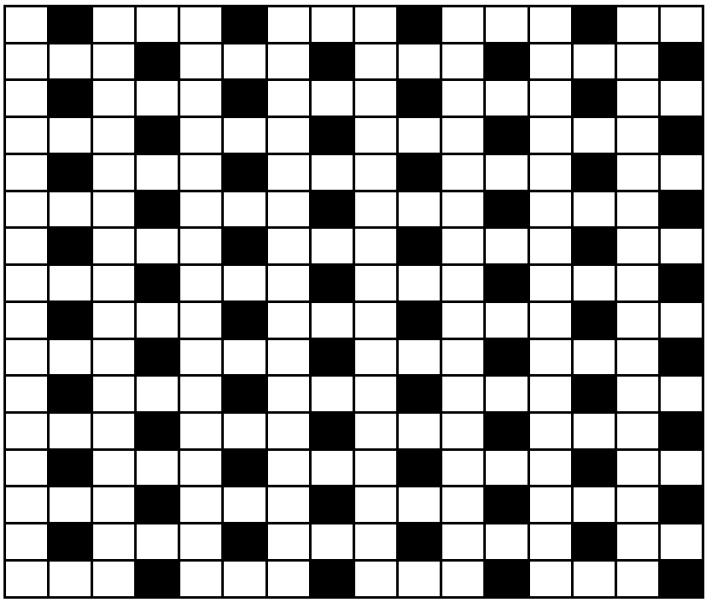

The ghost image evaluation was performed by the following method. After the completion of the printing, printing for ghost image evaluation was performed and a white image was printed in the entire sheet. The printing for ghost image evaluation is described below. As shown in FIG. 3A, quadrilateral solid images were printed in a white background (white image) at the top part of an image, and then a one-dot Keima pattern image was printed. The one-dot Keima pattern image in FIG. 3A is the pattern image shown in FIG. 3B. The portions referred to as "ghost" in FIG. 3A are ghost portions used to evaluate whether ghosts caused by the solid images appear. When ghosts appear, they appear in the portions referred to as "ghost" in FIG. 3A.

The sampling for ghost image evaluation was conducted in the F9 mode of the developing volume of the electrophotographic apparatus for evaluation. The ghosts were evaluated by measuring the difference in image density between the one-dot Keima pattern image and the ghost portions using a SpectroDensitometer (trade name: X-Rite 504/508 manufactured by X-Rite Inc.). The degree of a ghosting phenomenon decreases as the difference in image density decreases, which means a good result. The following ghost ranks were given in accordance with the difference in image density.

Rank 1 was a level at which ghosts are not visible. Ranks 2 and 3 were levels at which ghosts are slightly visible. Ranks 4 and 5 were levels at which ghosts are clearly visible.

Rank 1: The difference in image density is more than 0.000 and 0.015 or less.

Rank 2: The difference in image density is 0.016 or more and 0.025 or less.

Rank 3: The difference in image density is 0.026 or more and 0.035 or less.

Rank 4: The difference in image density is 0.036 or more and 0.050 or less.

Rank 5: The difference in image density is 0.051 or more.

TABLE 2

| | Ghost rank (high-temperature and high-humidity environment) | | | | Ghost rank (low-temperature and low-humidity environment) | | | |
|---|---|---|---|---|---|---|---|---|
| | Initial | Immediately after printing of 5000 sheets | Immediately after printing of 10000 sheets | 15 hours after printing of 10000 sheets | Initial | Immediately after printing of 5000 sheets | Immediately after printing of 10000 sheets | 15 hours after printing of 10000 sheets |
| Ex. 1 | 1 | 1 | 1 | 1 | 1 | 1 | 1 | 1 |
| Ex. 2 | 1 | 1 | 1 | 1 | 1 | 1 | 2 | 2 |
| Ex. 3 | 1 | 1 | 1 | 1 | 1 | 1 | 1 | 1 |
| Ex. 4 | 1 | 1 | 1 | 1 | 1 | 1 | 1 | 1 |
| Ex. 5 | 1 | 1 | 1 | 1 | 1 | 1 | 1 | 1 |
| Ex. 6 | 1 | 1 | 1 | 1 | 1 | 1 | 2 | 1 |
| Ex. 7 | 1 | 1 | 1 | 1 | 1 | 1 | 1 | 1 |
| Ex. 8 | 1 | 1 | 1 | 1 | 1 | 1 | 1 | 1 |
| Ex. 9 | 1 | 1 | 1 | 1 | 1 | 1 | 1 | 1 |
| Ex. 10 | 1 | 1 | 1 | 1 | 1 | 1 | 2 | 1 |
| Ex. 11 | 1 | 1 | 1 | 1 | 1 | 1 | 2 | 1 |
| Ex. 12 | 1 | 1 | 2 | 1 | 1 | 1 | 2 | 2 |
| Ex. 13 | 1 | 1 | 1 | 1 | 1 | 1 | 1 | 1 |
| Ex. 14 | 1 | 1 | 1 | 1 | 1 | 1 | 1 | 1 |
| Ex. 15 | 1 | 1 | 1 | 1 | 1 | 1 | 1 | 1 |
| Ex. 16 | 1 | 1 | 1 | 1 | 1 | 1 | 2 | 1 |
| Ex. 17 | 1 | 1 | 2 | 1 | 1 | 2 | 2 | 2 |
| Ex. 18 | 1 | 1 | 1 | 1 | 1 | 2 | 2 | 1 |
| Ex. 19 | 1 | 1 | 1 | 1 | 1 | 1 | 2 | 1 |
| Ex. 20 | 1 | 1 | 1 | 1 | 1 | 1 | 2 | 1 |
| Ex. 21 | 1 | 1 | 1 | 1 | 1 | 2 | 2 | 2 |
| Ex. 22 | 1 | 1 | 1 | 1 | 1 | 1 | 1 | 1 |
| Ex. 23 | 1 | 1 | 1 | 1 | 1 | 1 | 1 | 1 |
| Ex. 24 | 1 | 1 | 1 | 1 | 1 | 1 | 2 | 1 |
| Ex. 25 | 1 | 1 | 1 | 1 | 1 | 1 | 1 | 1 |
| Ex. 26 | 1 | 1 | 1 | 1 | 1 | 1 | 1 | 1 |
| Ex. 27 | 1 | 1 | 1 | 1 | 1 | 1 | 1 | 1 |

TABLE 2-continued

| | Ghost rank (high-temperature and high-humidity environment) | | | | Ghost rank (low-temperature and low-humidity environment) | | | |
|---|---|---|---|---|---|---|---|---|
| | Initial | Immediately after printing of 5000 sheets | Immediately after printing of 10000 sheets | 15 hours after printing of 10000 sheets | Initial | Immediately after printing of 5000 sheets | Immediately after printing of 10000 sheets | 15 hours after printing of 10000 sheets |
| Ex. 28 | 1 | 1 | 2 | 1 | 1 | 2 | 2 | 1 |
| Ex. 29 | 1 | 1 | 2 | 1 | 1 | 2 | 2 | 1 |
| Ex. 30 | 1 | 1 | 2 | 1 | 1 | 2 | 2 | 1 |
| Ex. 31 | 1 | 1 | 2 | 1 | 1 | 2 | 2 | 1 |
| Ex. 32 | 1 | 1 | 2 | 1 | 1 | 2 | 2 | 2 |
| Ex. 33 | 1 | 1 | 2 | 1 | 1 | 2 | 2 | 1 |
| Ex. 34 | 1 | 2 | 2 | 2 | 2 | 2 | 3 | 2 |
| Ex. 35 | 1 | 2 | 2 | 2 | 2 | 2 | 3 | 2 |
| Ex. 36 | 1 | 1 | 2 | 1 | 1 | 2 | 2 | 2 |
| Ex. 37 | 1 | 1 | 2 | 1 | 1 | 2 | 2 | 2 |
| Ex. 38 | 1 | 1 | 2 | 2 | 1 | 2 | 2 | 2 |
| Ex. 39 | 1 | 1 | 2 | 1 | 1 | 2 | 2 | 2 |
| Ex. 40 | 1 | 1 | 2 | 1 | 1 | 2 | 2 | 2 |
| Ex. 41 | 1 | 1 | 2 | 1 | 1 | 2 | 2 | 2 |
| Ex. 42 | 1 | 1 | 1 | 1 | 1 | 1 | 2 | 1 |
| Ex. 43 | 1 | 1 | 1 | 1 | 1 | 2 | 2 | 1 |
| Ex. 44 | 1 | 1 | 1 | 1 | 1 | 1 | 2 | 1 |
| Ex. 45 | 1 | 1 | 1 | 1 | 1 | 2 | 2 | 1 |
| C.E. 1 | 2 | 3 | 4 | 4 | 3 | 5 | 5 | 4 |
| C.E. 2 | This cannot be evaluated due to lack of sensitivity | | | | This cannot be evaluated due to lack of sensitivity | | | |
| C.E. 3 | 1 | 1 | 2 | 2 | 1 | 2 | 3 | 3 |
| C.E. 4 | 1 | 1 | 2 | 2 | 1 | 3 | 3 | 3 |

Ex.: Example,
C.E.: Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-050343, filed Mar. 13, 2013, which is hereby incorporated by reference herein in its entirety.

The invention claimed is:

1. An electrophotographic photosensitive member comprising:

a support;

an undercoat layer which comprises a metal oxide particle and is formed on the support;

a charge generating layer formed on the undercoat layer; and a charge transporting layer formed on the charge generating layer, wherein either or both of the undercoat layer and the charge generating layer comprise a compound represented by the following formula (1),

[Chem. 1]

(1)

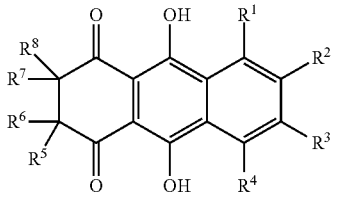

wherein $R^1$ to $R^8$ each independently represents a hydrogen atom, an alkyl group, a hydroxy group, an amino group, or a carboxyl group.

2. The electrophotographic photosensitive member according to claim 1, wherein $R^1$ to $R^8$ each independently represents a hydrogen atom or a hydroxy group.

3. The electrophotographic photosensitive member according to claim 1, wherein the undercoat layer comprises the compound represented by the formula (1).

4. The electrophotographic photosensitive member according to claim 3, wherein a content of the compound represented by the formula (1) in the undercoat layer is 0.01% by mass or more and 50% by mass or less relative to the metal oxide particle contained in the undercoat layer.

5. The electrophotographic photosensitive member according to any one of claim 1, wherein the charge generating layer comprises the compound represented by the formula (1).

6. The electrophotographic photosensitive member according to claim 5, wherein a content of the compound represented by the formula (1) in the charge generating layer is 0.02% by mass or more and 20% by mass or less relative to a charge generating substance contained in the charge generating layer.

7. The electrophotographic photosensitive member according to any one of claim 1, wherein the metal oxide particle is a particle containing at least one selected from the group consisting of titanium oxide, zinc oxide, and tin oxide.

8. A method for producing an electrophotographic photosensitive member including an undercoat layer which comprises a metal oxide particle and is formed on a support, a charge generating layer formed on the undercoat layer, and a charge transporting layer formed on the charge generating layer, the method comprising:

forming a coat of an undercoat layer coating solution containing the metal oxide particle and a compound represented by the following formula (1) on a support; and drying the coat by heating to form an undercoat layer,

[Chem. 1]

(1)

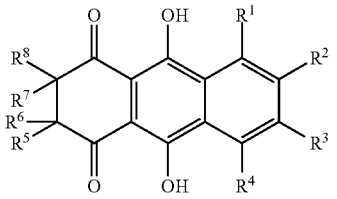

wherein $R^1$ to $R^8$ each independently represents a hydrogen atom, an alkyl group, a hydroxy group, an amino group, or a carboxyl group.

9. A method for producing an electrophotographic photosensitive member including an undercoat layer which comprises a metal oxide particle and is formed on a support, a charge generating layer formed on the undercoat layer, and a charge transporting layer formed on the charge generating layer, the method comprising:

forming a coat of a charge generating layer coating solution containing a charge generating substance and a compound represented by the following formula (1) on an undercoat layer; and drying the coat by heating to form a charge generating layer,

[Chem. 1]

(1)

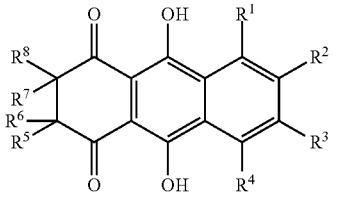

wherein $R^1$ to $R^8$ each independently represents a hydrogen atom, an alkyl group, a hydroxy group, an amino group, or a carboxyl group.

10. A process cartridge detachably attachable to a main body of an electrophotographic apparatus, wherein the process cartridge integrally supports:

an electrophotographic photosensitive member, and at least one device selected from the group consisting of a charging device, a developing device, a transferring device, and a cleaning device, wherein the electrophotographic photosensitive member comprises:

a support;

an undercoat layer which comprises a metal oxide particle and is formed on the support;

a charge generating layer formed on the undercoat layer; and a charge transporting layer formed on the charge generating layer, wherein either or both of the undercoat layer and the charge generating layer comprise a compound represented by the following formula (1),

[Chem. 1]

(1)

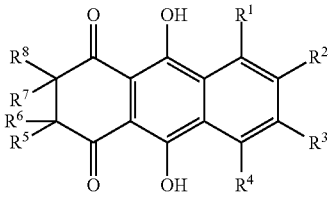

wherein $R^1$ to $R^8$ each independently represents a hydrogen atom, an alkyl group, a hydroxy group, an amino group, or a carboxyl group.

11. An electrophotographic apparatus comprising:

an electrophotographic photosensitive member;

a charging device;

an exposure device;

a developing device; and a transferring device, and wherein the electrophotographic photosensitive member comprises:

a support;

an undercoat layer which comprises a metal oxide particle and is formed on the support;

a charge generating layer formed on the undercoat layer; and a charge transporting layer formed on the charge generating layer, wherein either or both of the undercoat layer and the charge generating layer comprise a compound represented by the following formula (1),

[Chem. 1]

(1)

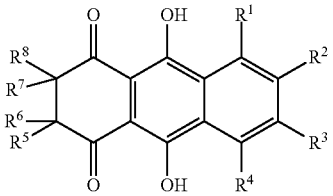

wherein $R^1$ to $R^8$ each independently represents a hydrogen atom, an alkyl group, a hydroxy group, an amino group, or a carboxyl group.

* * * * *